US006663308B1

(12) United States Patent
Michelizzi

(10) Patent No.: US 6,663,308 B1
(45) Date of Patent: Dec. 16, 2003

(54) PEN WARMER

(76) Inventor: John Michelizzi, 127 E. Toledo St., Duluth, MN (US) 55811

( * ) Notice: Subject to any disclaimer, the term of this patent is extended or adjusted under 35 U.S.C. 154(b) by 0 days.

(21) Appl. No.: 10/202,808

(22) Filed: Jul. 25, 2002

(51) Int. Cl.[7] ..... B43K 29/00; B43K 23/02
(52) U.S. Cl. ..... 401/195; 401/131; 219/201
(58) Field of Search ..... 401/52, 195, 248, 401/131, 1, 2; 219/200, 201, 221

(56) References Cited

U.S. PATENT DOCUMENTS

| | | | | |
|---|---|---|---|---|
| 338,019 A | | 3/1886 | Bartram | |
| 450,197 A | | 4/1891 | Shattuck | |
| 2,033,897 A | | 3/1936 | Jenkins et al. | 219/29 |
| 2,488,477 A | | 11/1949 | Rapaport | 219/29 |
| 4,061,430 A | | 12/1977 | Herrnring | 401/216 |
| 4,139,424 A | | 2/1979 | Herrnring | 204/26 |
| 4,798,934 A | * | 1/1989 | Boyer | 219/233 |
| 5,546,108 A | | 8/1996 | Hotomi et al. | 347/55 |
| 5,737,740 A | | 4/1998 | Henderson et al. | 707/530 |

* cited by examiner

*Primary Examiner*—David J. Walczak
(74) *Attorney, Agent, or Firm*—Westman, Champlin & Kelly, P.A.

(57) ABSTRACT

A device for warming a writing tip of a pen having a conductive surface spaced from the writing tip, the device includes a power source having a first terminal and a second terminal. A first electrically conductive member is attached to the first terminal and a second electrically conductive member is attached to the second terminal and spaced from the first conductive member. The conductive surface of the pen contacts the second electrically conductive member when the writing tip of the pen contacts the first conductive member thereby warming the writing tip.

14 Claims, 1 Drawing Sheet

PEN WARMER

BACKGROUND OF THE INVENTION

The present invention relates to a device for heating a writing pen. More specifically, the present invention relates to an electric circuit for warming the writing tip of the pen.

Writing instruments have been used since the beginning of time to record thoughts, events and history. Early cave men used sharpened stones to scratch pictures into the walls of caves. With the advancement of civilization, alphabets developed along with the written word. One of the earliest pens was developed by the Romans from a hollow reed such as bamboo. One end of the reed was cut into a point and ink was poured into the stem. The writer squeezed the wall of the reed to provide ink to the tip.

Around the eighth century the quill pen was introduced. The quill pen was made from a bird's feather. The quill was sharpened to a point and was dipped into an ink well. The writer used the wet ink on the tip of the quill to write. On average, the useful life of a quill pen was about a week after which time the quill needed to be replaced. The quill pen was the most popular writing instrument for about one thousand years until the introduction of the fountain pen in the early nineteenth century.

In the nineteenth century the fountain pen was developed and replaced the quill pen. The fountain pen had several advantages over the quill pen including having an internal ink reservoir. The internal ink reservoir eliminated the need to repeatedly dip the end of the pen into an ink well. Additionally, because the writing end of the fountain pen was metal, the fountain pen had a considerably longer useful life as compared to the quill pen.

A major drawback of fountain pens was the likelihood of spilling ink especially when attempting to refill the reservoir. Additionally, the ink for a fountain pen did not dry quickly resulting in the ink smearing and smudging.

The ball point pen was developed to eliminate the problem of smearing and smudging associated with the inks used in fountain pens. Ball point pens use an internal reservoir similar to fountain pens, but the ink used is a thicker ink which dries almost instantly after being applied to paper. To apply ink from a ball point pen to paper, the ball is rotated by applying pressure to paper. As the ball is rotated, ink which clings to the ball is removed from the reservoir and applied to the paper.

Because a thicker ink is used in ball point pens, several events can occur which prevent the ball point pen from writing. A pen may not be used for an extended period of time resulting in the ink drying around the ball which will prevent the ball from rolling. A second event which prevents a ball point pen from writing is cold weather which results in the ink becoming viscous and not being able to flow.

Usually when a ball point pen will not write, the pen is vigorously moved over a piece of paper. The movement can either heat the tip of the pen with friction which reduces the viscosity of the ink. Alternatively, if the ball is fixed into one position with dry ink, the force of the moving the tip over the piece of paper may break the ball lose from the dried ink. In addition to vigorously moving the ball point pen over a piece of paper, other techniques for making a ball point pen including wetting the tip of the pen to moisturize the dry ink and sucking on the tip of the pen to pull ink around the ball point and establish ink flow. If none of the above techniques do not enable the ball point pen to begin writing the pen is typically discarded.

BRIEF SUMMARY OF THE INVENTION

The present invention is a device for warming a writing tip of a pen having a conductive surface spaced from the writing tip, the device includes a power source having a first terminal and a second terminal. A first electrically conductive member is attached to the first terminal and a second electrically conductive member is attached to the second terminal and spaced from the first conductive member. The conductive surface of the pen contacts the second electrically conductive member when the writing tip of the pen contacts the first conductive member thereby warming the writing tip.

DETAILED DESCRIPTION

Figure 1:
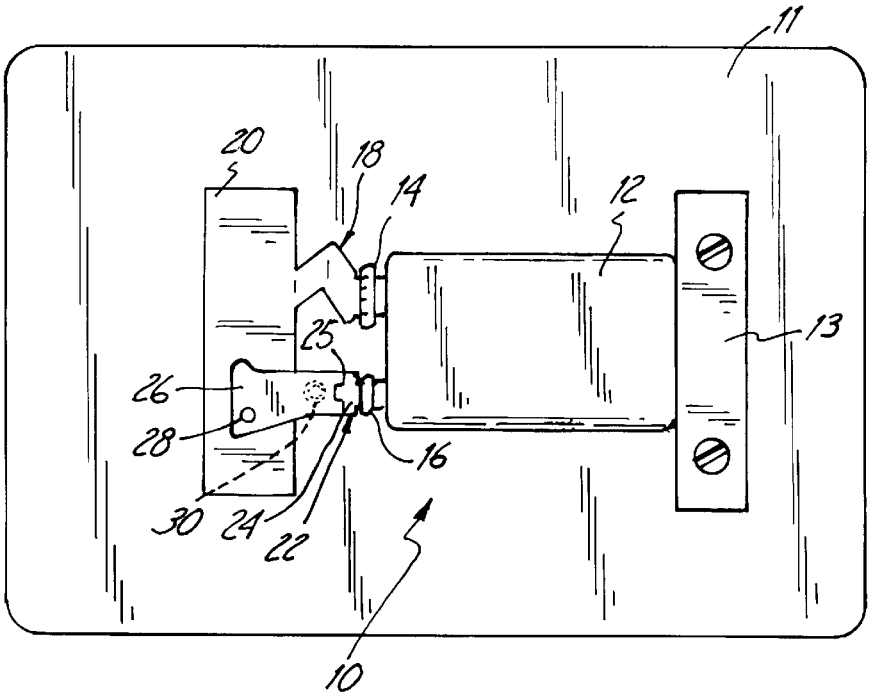
FIG. 1 is a top view of the pen warmer of the present invention.

A pen warmer of the present invention is generally illustrated at 10 in FIG. 1. The pen warmer 10 includes a power source 12 having first and second terminals 14, 16, respectively. A writing tip 34 of a pen 32 is used to connect the first and second terminals 14, 16 such that a current flows through and warms the writing tip 34 of the pen 32 as illustrated in FIG. 2.

Figure 2:
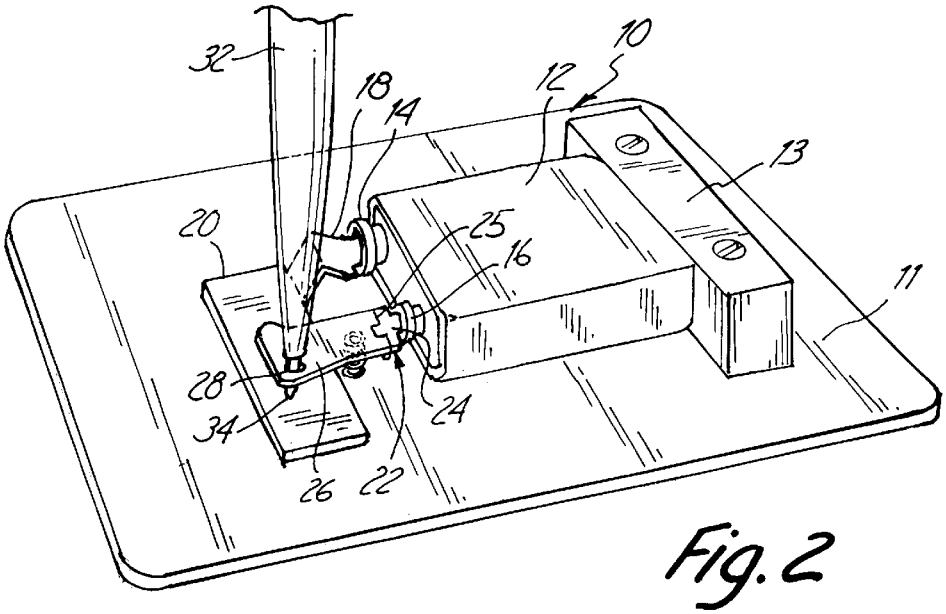
FIG. 2 is a partial perspective view of a writing tip of a pen connecting a circuit of the pen warmer of the present invention.

Referring to FIGS. 1 and 2, the power source 12 is preferably a nine volt dry cell battery, although other power sources, including other dry cell batteries or other direct current or alternating current sources are within the scope of the invention. The dry cell battery 12 is retained on a base 11 by a stop 13 which preferably is attached to a base 11 with screws. The base 11 is constructed of a non-conductive material, preferably wood.

A first conductive member 18 is attached to the first terminal 14. The first conductive member 18 includes a conductive metal strip 20 that is attached to the base 11.

A second conductive member 22 is attached to the second terminal 16. A distal end of the second conductive member 22 is disposed over the conductive metal strip 20.

Preferably, the second conductive member 22 includes a first portion 24 which is attached to the second terminal 16 and a second portion 26 attached to the first portion 24 by a hinge 25. A compression spring 30 biases the second portion 26 of the second conductive member 22 away from the first conductive member 18 thereby preventing the first and second conductive members 18, 22 from making contact and completing the circuit. The second portion 26 includes an aperture 28 which is disposed above the conductive metal strip 20 of the first conductive member 18. Although, a second conductive member 22 having two portions 24, 26 hingedly attached is preferred, one skilled in the art will recognize that a single member is within the scope of the invention.

In operation, the writing tip 34 of the pen 32 is inserted into the aperture 28 in the second portion 26 of the second conductive member 22 until a side surface of the writing tip 34 contacts the surface of the aperture 28. A force is applied to the pen 32 which overcome the bias of the compression spring 30 to force the second portion 26 of the second conductive member 22 towards the first conductive member 18 until the writing tip 34 of the pen 32 contacts the first conductive member 18. The circuit is completed when the writing tip 34 of the pen 32 contacts the first conductive member 18 and the side surface 36 of the writing tip 34 contacts the second conductive member 22. With the completed circuit, current flows from the first terminal 14 through the writing tip 34 of the pen 32 and to the second terminal 16. One skilled in the art will recognize that the polarity of the first and second terminals 14, 16 can be switched and still achieve the same result, namely current running through and warming the writing tip 34 of the pen 32.

Typically, the pen 32 connects the circuit for about five seconds after which time the writing tip 34 has been sufficiently warmed to enable the pen 32 to write. The pen warmer 10 is also useful in making a working pen write better by heating the tip of the pen. Additionally, the pen warmer 10 is useful as a paperweight.

Although the present invention has been described with reference to preferred embodiments, workers skilled in the art will recognize that changes may be made in form and detail without departing from the spirit and scope of the invention.

What is claimed is:

1. A device for warming a writing tip of a pen, the pen having a conductive surface spaced from the writing tip, the device comprising:

a power source having a first terminal and a second terminal;

a first electrically conductive member attached to the first terminal;

a second electrically conductive member attached to the second terminal and spaced from the first conductive member such that the conductive surface of the pen contacts the second electrically conductive member when the writing tip of the pen contacts the first conductive member thereby warming the writing tip; and wherein the second electrically conductive member includes an aperture and wherein the writing tip of the pen is inserted into the aperture and wherein the conductive surface of the pen a distance from the writing tip of the pen contacts the aperture.

2. The device of claim 1 wherein the electric power source comprises a dry cell battery.

3. The device of claim 1 wherein the electric power source comprises a nine volt dry cell battery.

4. The device of claim 1 wherein the second electrically conductive member comprises:

a first portion connected to the second terminal; and a second portion hingedly connected to the first portion wherein the aperture is disposed within the second portion.

5. The device of claim 4 and further comprising a compression spring communicating with the second portion of the second electrically conductive member wherein the compression spring biases the second portion a distance from the first electrically conductive member.

6. The device of claim 1 and further comprising a non-conductive base wherein the base secures the power source thereto.

7. A device for warming a writing tip of a pen by flowing an electric current therethrough, the pen having a conductive surface spaced from the writing tip, the device comprising:

an electric power source having a first terminal and a second terminal;

a first electrically conductive member attached to the first terminal;

a second electrically conductive member attached to the second terminal and spaced from the first electrically conductive member such that the writing tip of the pen contacts the first electrically conductive member and the conductive surface of the pen contacts the second electrically conductive member thereby completing a circuit for electric current to flow through the writing tip of the pen; and wherein the second electrically conductive member comprises an aperture wherein the writing tip of the pen is inserted into the aperture such that the electrically conductive surface a distance from the writing tip contacts the second electrically conductive member.

8. The device of claim 7 wherein the electric power source comprises a dry cell battery.

9. The device of claim 7 wherein the electric power source comprises a nine volt dry cell battery.

10. The device of claim 7 wherein the second electrically conductive member comprises:

a first portion connected to second terminal of the electric power source; and a second portion hingedly connected to the first portion wherein the aperture is disposed with the second portion.

11. The device of claim 10 and further comprising a compression spring communicating with the second portion of the second electrically conductive member wherein the compression spring biases the second portion from contacting the first electrically conductive member.

12. The device of claim 7 and further comprising a non-conductive base wherein at least one of the first and second electrically conductive members is attached thereto.

13. A method for heating a writing tip of a pen, the method comprising:

providing electrical contacts spaced apart a distance to contact the writing tip of the pen and an electrically conductive surface of the pen wherein one of the contacts includes and aperture for current to flow from the writing tip to the conductive surface; and placing the writing tip of the pen and the electrically conductive surface in electrical contact with the spaced apart electrical contacts by inserting the tip of the pen into the aperture to produce a current path from one contact to the other thereby inducing current to flow through the writing tip.

14. The method of claim 13 and further comprising:

biasing the electrical contacts apart from each other such that only the writing tip and the electrically conductive surface complete a circuit whereby current flows through the writing tip.

* * * * *